US006447327B2

(12) United States Patent
Shimogama et al.

(10) Patent No.: US 6,447,327 B2
(45) Date of Patent: Sep. 10, 2002

(54) CONNECTION CABLE APPARATUS

(75) Inventors: Shigeru Shimogama, Hyogo (JP); Shiaki Suzuki, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/817,209

(22) Filed: Mar. 27, 2001

(30) Foreign Application Priority Data

Mar. 28, 2000 (JP) ..... 2000-088016

(51) Int. Cl.[7] ..... H01R 13/58
(52) U.S. Cl. ..... 439/470
(58) Field of Search ..... 439/470, 369, 439/445, 471

(56) References Cited

U.S. PATENT DOCUMENTS 4,564,255 A * 1/1986 Kirma ..... 439/470
4,641,899 A * 2/1987 Gallusser et al. ..... 439/470
4,666,229 A * 5/1987 Grand ..... 439/470
4,863,396 A * 9/1989 Johnson ..... 439/470
5,211,706 A * 5/1993 Polgar ..... 439/465
5,518,421 A * 5/1996 Davis ..... 439/607
5,775,958 A * 7/1998 Luci ..... 439/752

FOREIGN PATENT DOCUMENTS

JP 6-187835 7/1994

* cited by examiner

*Primary Examiner*—Renee Luebke
*Assistant Examiner*—Briggitte R. Hammond
(74) *Attorney, Agent, or Firm*—Wenderoth, Lind & Ponack, L.L.P.

(57) ABSTRACT

A connection cable apparatus for protecting a connection cable of a robot comprises a connection section for connection to a robot connection cable, and a reinforcement plate. The reinforcement plate fixes the connection cable to the robot. This apparatus has an angle box disposed in the connection section, and is capable of varying the drawing direction of the connection cable. This apparatus includes plural wires, and a connection processing section to be connected to their terminals and a connector. In the connection processing section, of the plural wires, the length of the wires having a smaller sectional area is longer than the length of the wires having a larger sectional area. These wires are divided into groups, and effects of stress by bending of the connection cable are prevented.

14 Claims, 19 Drawing Sheets

CONNECTION CABLE APPARATUS

FIELD OF THE INVENTION

The present invention relates to a connection cable apparatus for connecting between a robot and a controls device.

BACKGROUND OF THE INVENTION

Generally, an industrial robot is installed on the floor. The signal wire for controlling the robot is called the connection cable, and includes the following types.

1) A composite cable containing plural wires in one sheath.

2) A cable with a connector attached by terminating cable ends having wires passed through a flexible tube.

These connection cables are disposed at non-moving parts in the lower part of the robot main body at the opposite side of the connector. Further by mutually coupling the connection cable: connector section and the receiving side connector section provided at the lower part of the robot main body, the signal from the control device is transmitted to the robot.

FIG. 18 shows a case of mounting a robot on a platform. The connection cable designed to be laid on the floor is used in such state of installation as shown in FIG. 18. The connection cable of straight connection type sags due to gravity.

Mainly, herein, the signal and power for controlling the servo motor of the robot main body are exchanged between the robot main body and control device through a harness called the connection cable bundling the signal wires and the power wires.

The connection section is separable by the connector. Signal wires of each harness are terminated, and soldered or crimped to the connector terminal, and inserted into the connector section main body.

The cable lock section fixes the harness at the cable lock section of the connector as follows.

i) When the harness is composed of bulk wires, the flexible tube through which the bulk wires are passed is fixed.

ii) When the harness is composed of composite cables, the armor of the composite cable is fixed.

In the following cases, the connector section of the connection cable might be broken, or the harness inside the connector might be disconnected.

i) If the user's foot catches the connection cable.

ii) If the user operates the robot by mistake while teaching the robot, and the end effector of the robot catches the connection cable main body.

Besides, when the robot main body is installed on the platform as shown in FIG. 18, the harness may be broken in the connector of the connection cable due to weight of connection cable or aging effects.

Accordingly, as a conventional method of protecting the connection cable, FIG. 19 shows a method disclosed, for example, in Japanese Laid-open Patent No. 6-187835.

In a joint cable 111 in FIG. 19, a reinforcing member 112 is supporting the weight of an underwater working machine. In this structure, therefore, tension does -not work on the connection cable.

If necessary to replace the connection cable during underwater work, this joint cable is replaced.

In the case of a floor-mount robot, the connection cable for linking between the robot and control device is laid down horizontally on the floor. Further, the connection cable is connected to the non-moving part of the robot. Therefore, nothing has been considered about its impact resistance.

At the time of teaching or maintenance of the robot, the operator often used to drag and pull the connection cable by himself or by a crane or a tool. The connection cable was sometimes damaged. Its effect was seen in the connector section at the junction of the robot main body lower part and the connection cable. Besides, when the robot is mounted on the platform as shown in FIG. 18, the connection cable sags by its own weight in the gravity direction. Therefore, strands of composite cable are pulled in the gravity direction. In the case of a tube, the wires in the tube are pulled in the gravity direction.

In addition, in both cases above, a stress is also applied due to the difference in the bending major diameter and bending minor diameter of the connection cable. As a result, a force larger than the specified value is applied on the pin of the connector.

When it is known beforehand that the robot is installed on a platform as shown in FIG. 18, an angle connector may be used as the connector section of the connection cable, so that the connection connector section and connection cable may be connected straightly. In this case, too, an eccentric load is applied on the connection cable connector section.

Besides, when the connection cable is caught, inevitably, an impact was applied on the connector section at the junction of the robot main body lower part and the connection cable.

In the case of angle connector type, it is mainly out of the standard product. It hence has effects on the cost and term of delivery.

In the case of FIG. 19, a connection cable 113 is laid along a reinforcing member 112, and is fixed to the reinforcing member 112 at plural positions by means of a bundling tool 125. At the connection end side to the underwater working machine, the connection cable 113 is inserted into a flexible tube 126 together with the reinforcing member 112, and is drawn outside through a hole penetrating through a coupling tool 116.

Connectors 121 are provided at both ends of the connection cable 113. Each connector 121 is connected to a connector 106 of a core 105 drawn out from a tether cable 102 and a connector o f the underwater working machine.

Through a joint cable 111 thus composed, the tether cable 102 and underwater working machine are connected as shown in FIG. 19. While the underwater working machine is working, in the joint cable 111, the weight of the underwater working machine is supported by the reinforcing member 112. Therefore, no tension acts on the connection cable 113.

If the joint cable 111 is damaged during the underwater work, the tether cable 102 is hoisted by the winch of the mother vessel, and the joint cable 111 and underwater working machine are lifted onto the mother vessel. By removing bolts 119, 123 of coupler 115 and coupling tool 116 of the joint cable 111, coupling of the reinforcing member 112, tether cable 102, and underwater working machine is cleared. The connectors 121 at both ends of the connection cable 113 are separated from the tether cable 102 and each connector of the underwater working machine.

Consequently, by a new joint cable 111, the tether cable 102 and underwater working machine are coupled. Again, the underwater working machine is put back into the water, and the operation is resumed.

That is, as for the cables, spare:joint cables 111 are prepared on the mother vessel. If necessary to replace the connection cable during underwater work, only the joint cable 111 is replaced.

Such exchange of connection cable is, however, difficult in the industrial robot. This is because the industrial robot is installed in a place of a complicated layout of machines and devices in the manufacturing line.

SUMMARY OF THE INVENTION

It is hence an object of the invention to protect the connection cable of the robot compactly.

1) A connection cable apparatus between a robot manipulator and its control device of the invention comprises connection units of a manipulator and a connection cable, and a reinforcement plate, in which the connection cable is fixed by using the reinforcement plate so that the connection cable may be firmly fixed.
2) A connection cable apparatus of the invention comprises connection units of a robot manipulator and a connection cable, and an angle box, in which the angle box stands between connection units, so that the drawing direction of the connection cable may be varied.
3) A connection cable apparatus of the invention comprises plural wires including a signal wire and a power wire, and a connection processing section of terminals of plural wires. In the connection processing section, the length of the wire having the smaller sectional area of the plural wires is longer than the length of the wire having the wider sectional area. Dividing these wires in groups, it is intended to prevent effects of stress due to difference between the bending major diameter and bending minor diameter of the connection cable.

Thus the invention presents a connection cable apparatus capable of protecting connection cable and connector section.

BRIEF DESCRIPTION OF THE DRAWINGS

FIG. 12(*b*) is an explanatory diagram of a suspended state of the connection cable connected to the robot lower connector section.

FIG. 13(*b*) is a diagram showing the state of a connection cable including a composite cable bent and connected to the robot main body.

FIG. 15(*b*) is a diagram showing the state of the cable passing wires in a bent flexible tube and connected to the robot main body.

DESCRIPTION OF THE PREFERRED EMBODIMENTS

Embodiment 1

An embodiment of the invention is explained by referring to FIG. 1, FIG. 2, FIG. 3, and FIG. 4.

Figure 2:
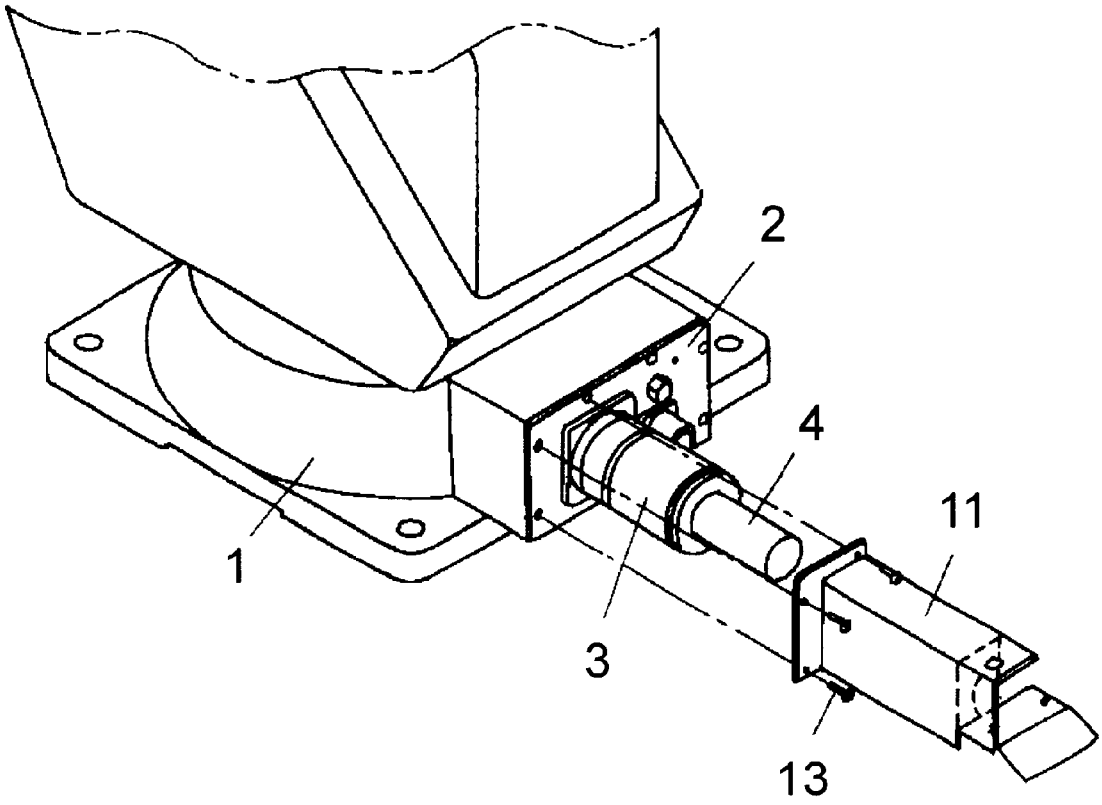
FIG. 2 is an explanatory diagram of mounting of a reinforcement plate on the robot lower connector section.

In FIG. 2, a connection cable 4 is firmly fixed to the junction of connection cable 4 and connection cable connector 3 by means of a reinforcement plate 11. A connector section 2 is a non-moving part disposed in the lower part of the robot main body 1. The connection cable 4 connects between the robot main body 1 and robot control device (not shown).

The reinforcement plate 11 has round holes. Screws 13 pass through the round holes, and tighten and fix the reinforcement plate 11 and connection cable connector 3 together to the connector section 2.

Figure 3:
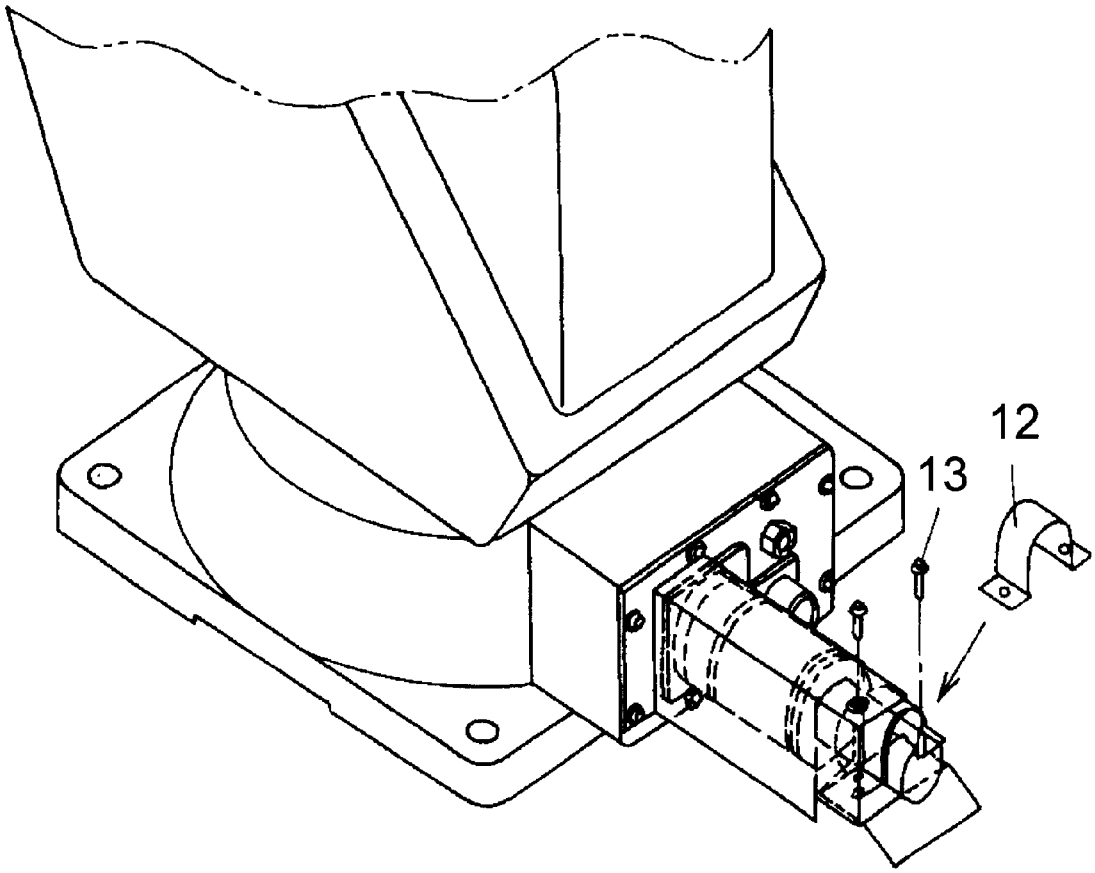
FIG. 3 is an explanatory diagram of mounting of a saddle after mounting the reinforcement plate on the robot lower connector section.

In FIG. 3, a saddle 12 is fixed to the fixed reinforcement plate 11 along the connection cable 4 by means of the screws 13.

Figure 1:
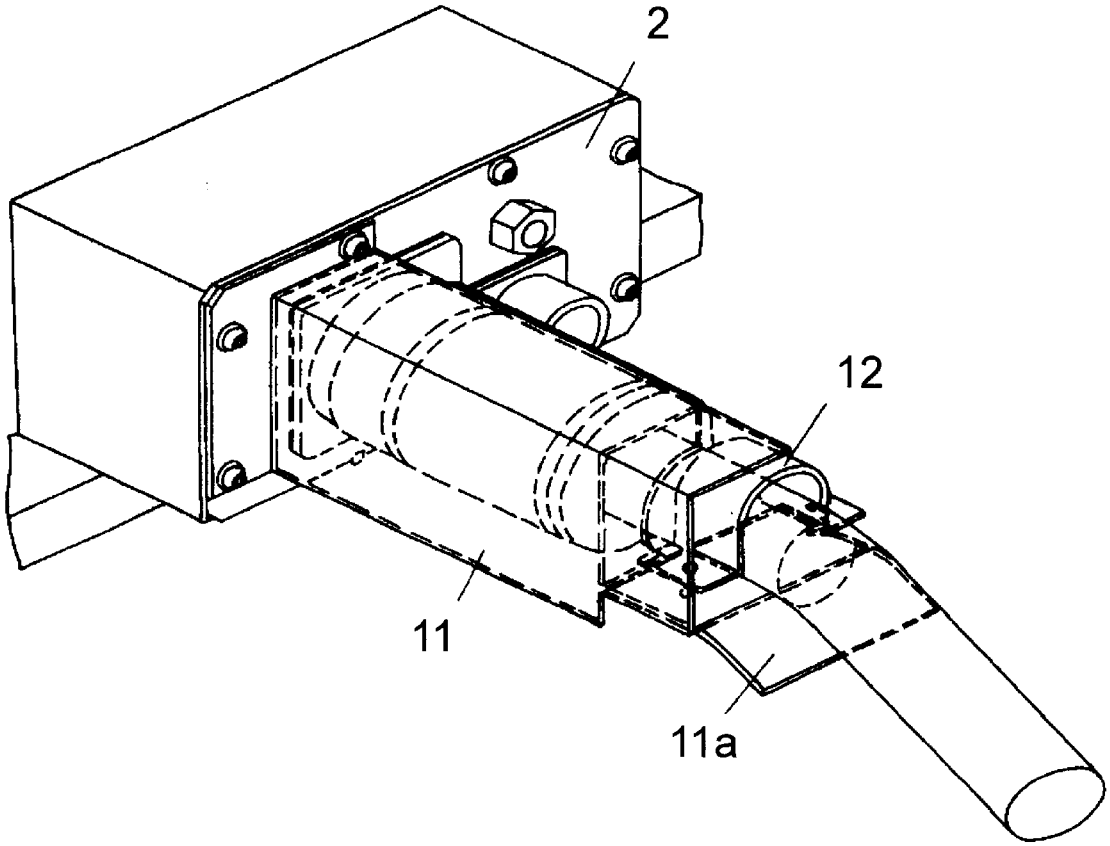
FIG. 1 is an explanatory diagram of connection section of a robot lower part having a reinforcement plate in an embodiment of the invention.

FIG. 1 is a perspective view of thus installed state of the reinforcement plate 11.

Figure 4:
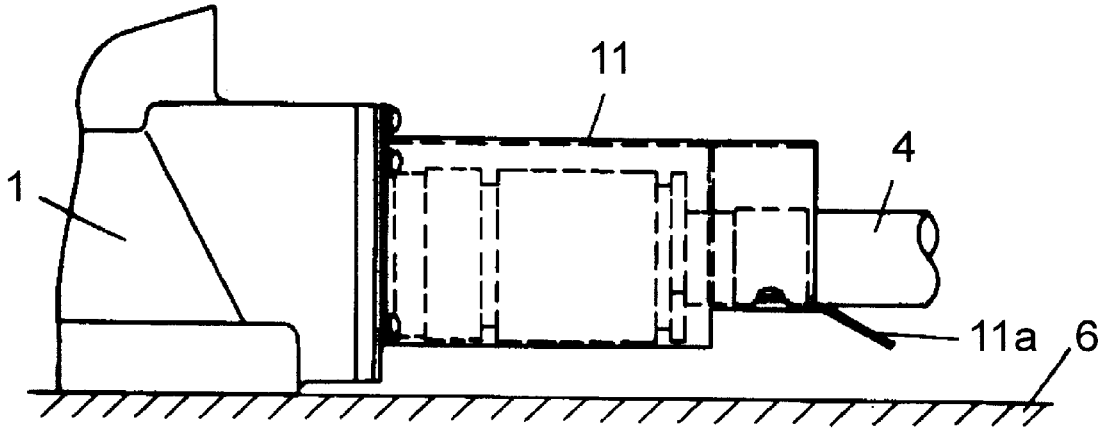
FIG. 4 is an explanatory diagram of a lower part connector section having a reinforcement plate of a floor mount robot.

FIG. 4 is its side view.

Herein, the reinforcement plate 11 has a guide 11*a*. Therefore, the cable forms a smooth curve if drooping by its own weight.

As shown in FIG. 4, when the robot main body 1 is installed on a horizontal floor 6, the reinforcement plate 11 does not interfere with the floor 6.

Figure 5:
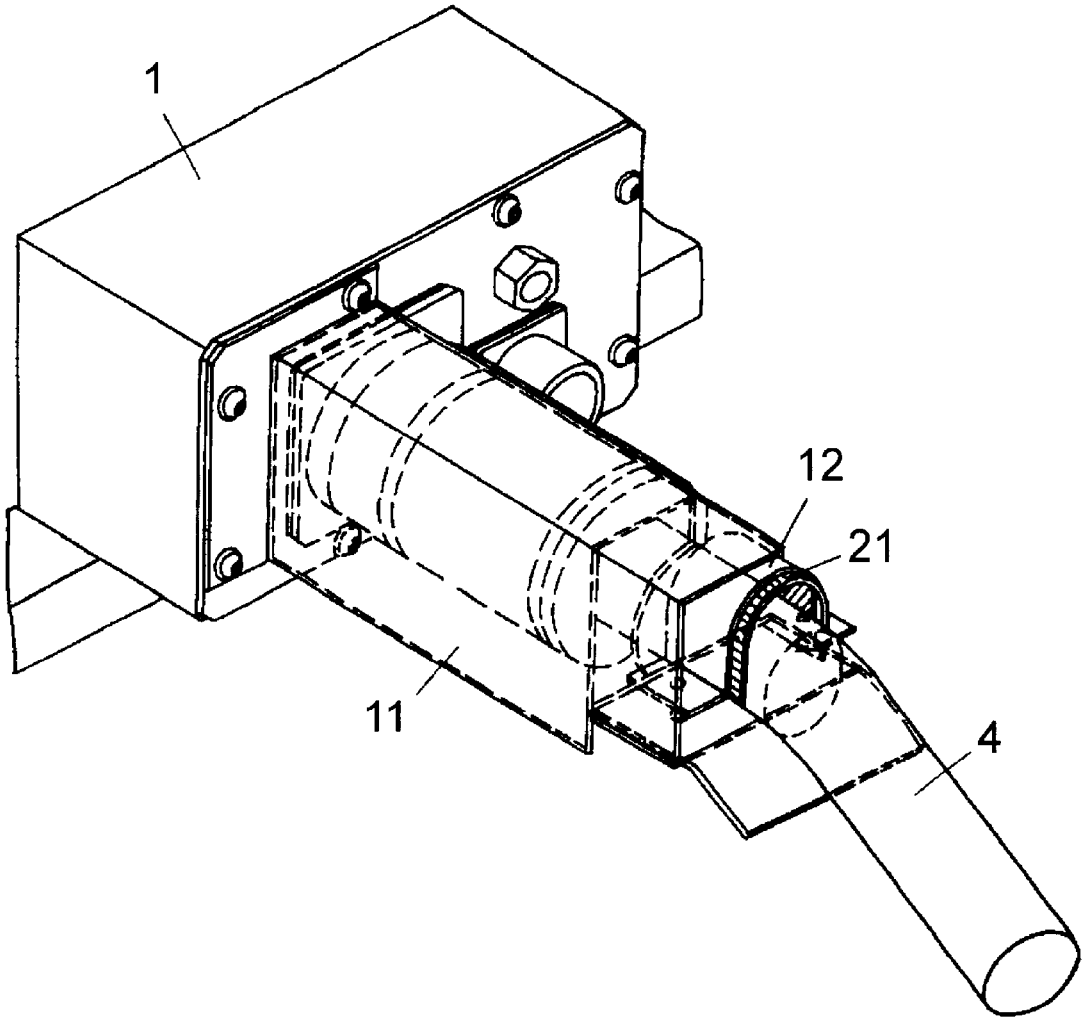
FIG. 5 is an explanatory diagram of mounting of a flexible member between the reinforcement plate of the robot lower connector section and the saddle.

Further, as shown in FIG. 5, a flexible member 21 is fitted to the saddle 12. At this time, the flexible member 21 is fitted into the reinforcement plate 11 by inserting between the connection cable 4 and saddle 12.

As a result, if the operator pulls the connection cable by accident at the time of robot teaching or maintenance, the connection cable is free from effects of impact.

Embodiment 2

Figure 6:
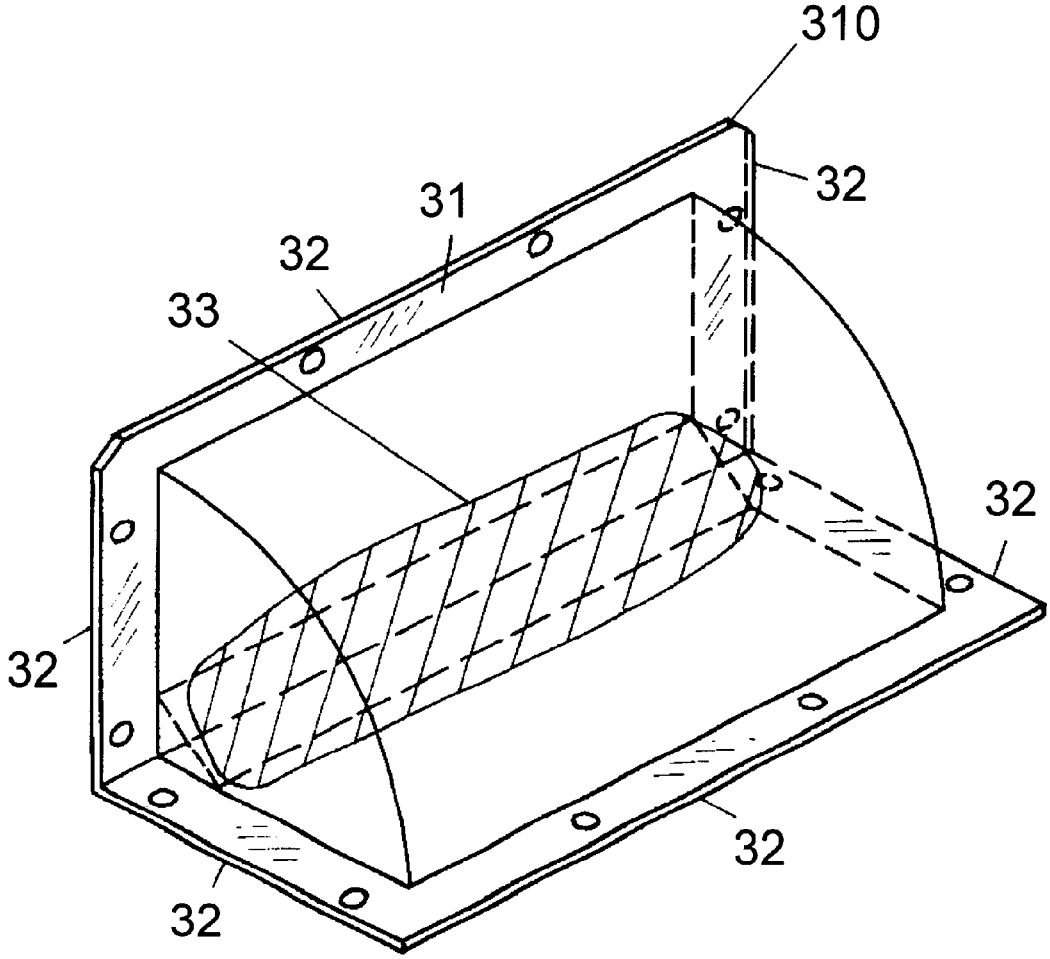
FIG. 6 is an explanatory diagram of an angle box suited to the robot lower connector section.

In this embodiment, at the junction of the robot main body and connection cable, an angle box 31 shown in FIG. 6 is installed.

Figure 8:
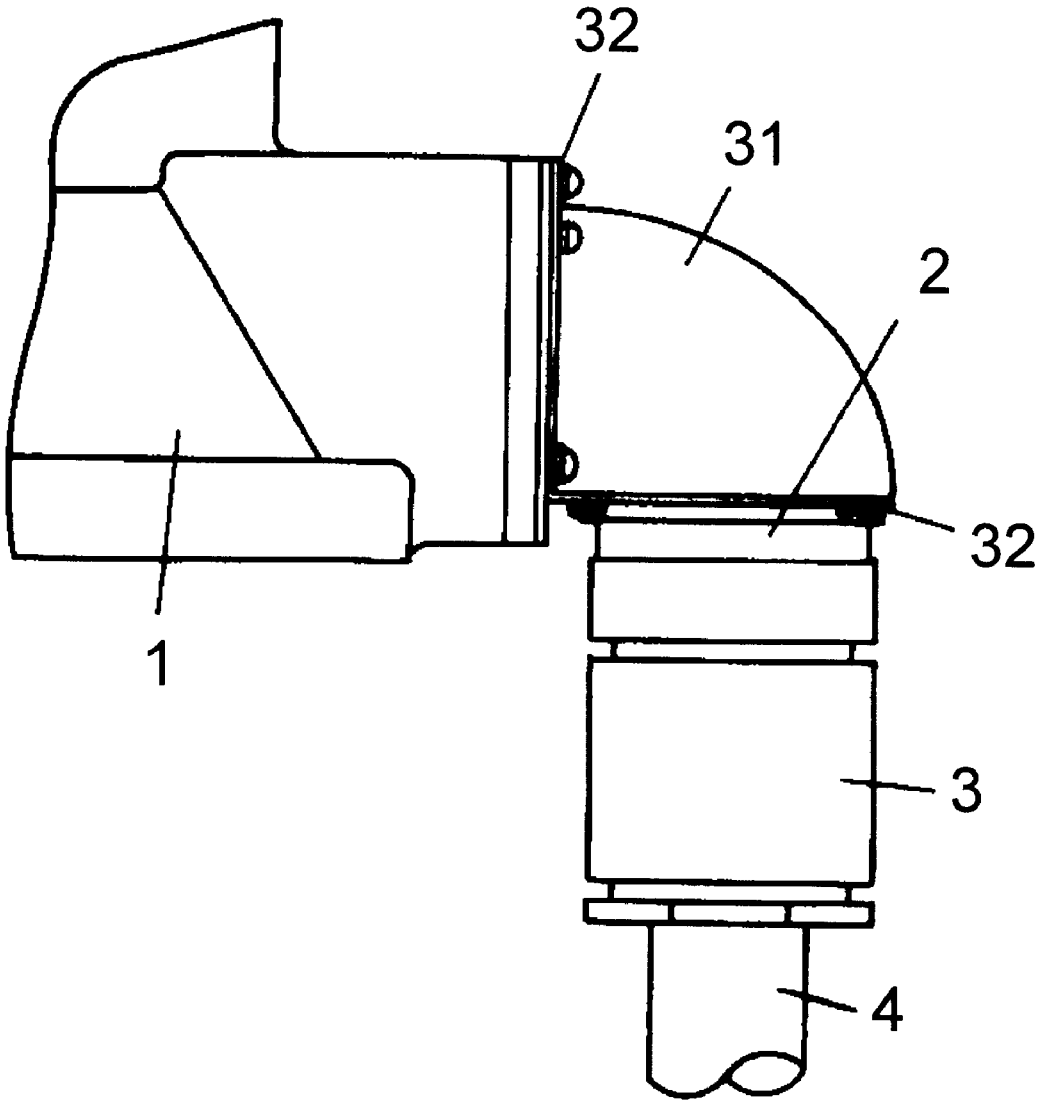
FIG. 8 is an explanatory diagram of mounting of an angle box on the robot lower connector section.

As shown in FIG. 8, the angle box 31 stands between the robot main body 1 and connector section 2, so that the drawing direction of the connection cable can be changed from the horizontal direction to the vertical direction.

Herein, the angle box 31 is fixed to the connector section 2 at the junction provided at its edge.

Figure 10:
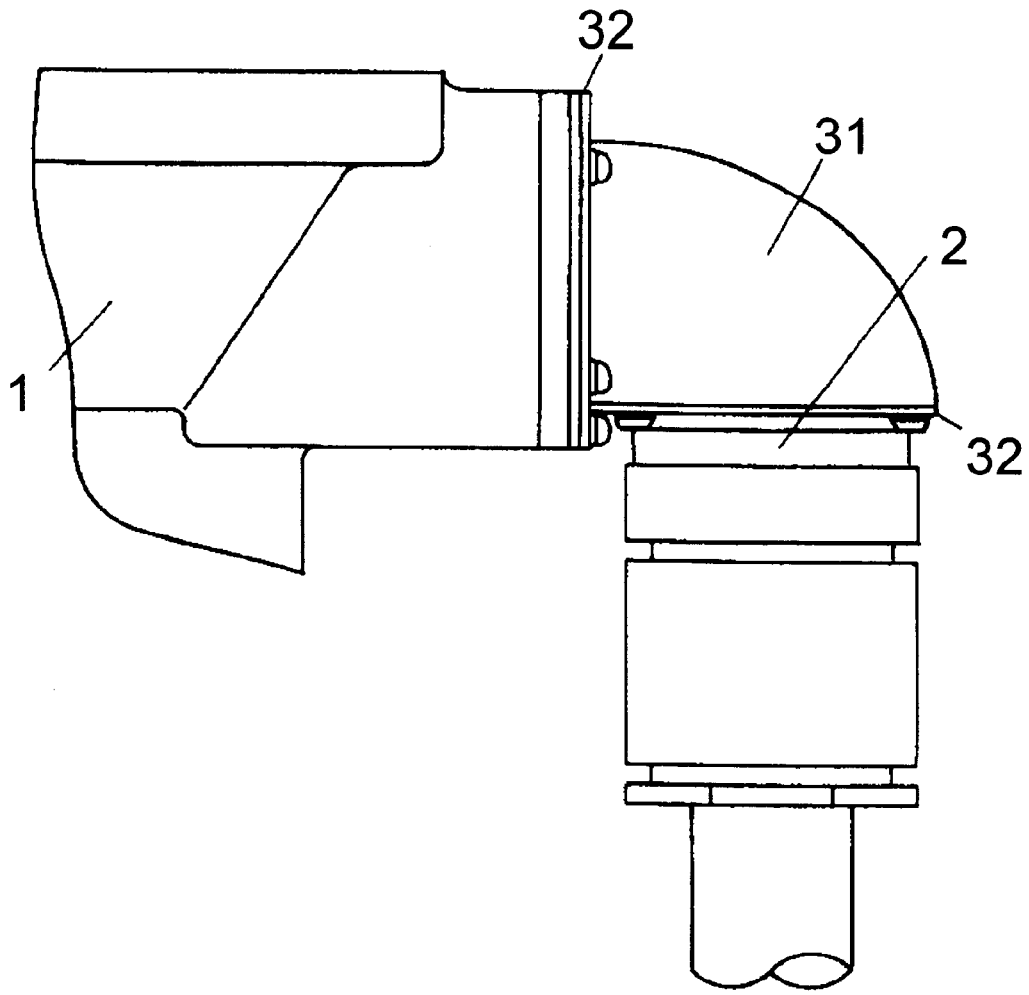
FIG. 10 is an explanatory diagram of mounting of an angle box on the lower part connector section of a downwardly depending type robot.

FIG. 10 shows that the same structure can be applied even if the robot main body 1 is of downwardly depending type.

Figure 7:
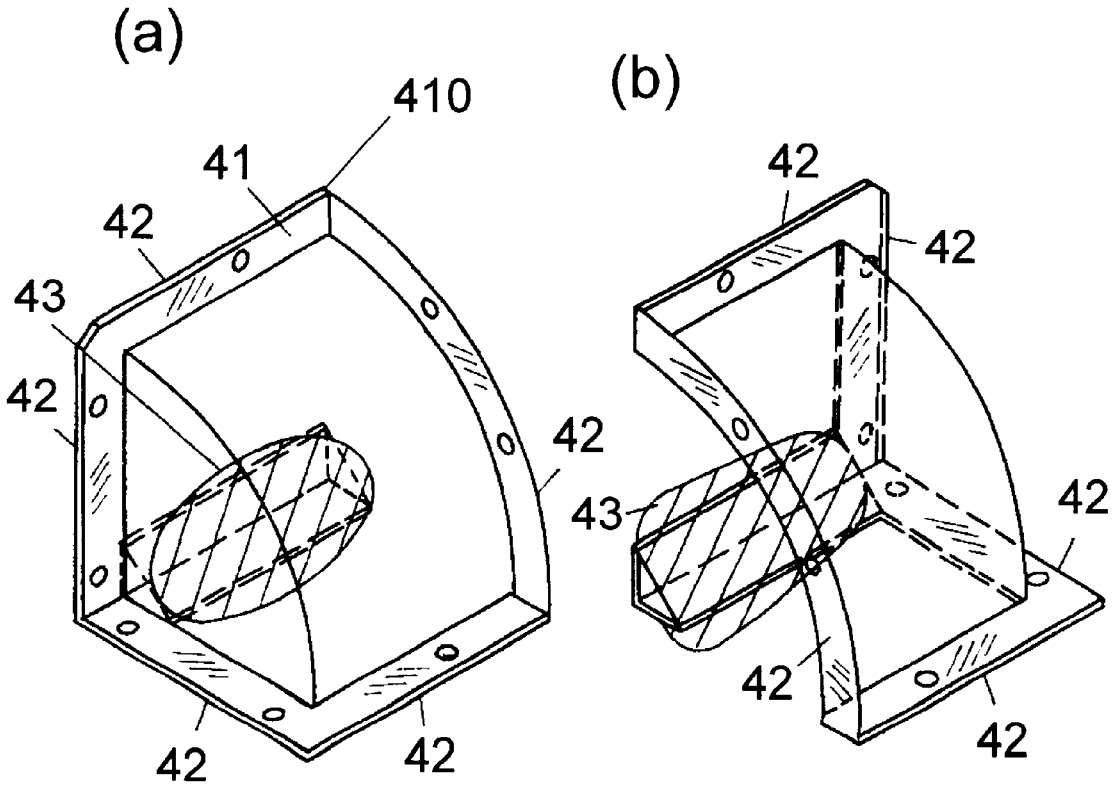
FIG. 7 is an explanatory diagram of an angle box of half-split structure suited to the robot lower connector section.

Further, as shown in FIG. 7, two angle box main bodies 41 may be disposed at the junction of the robot main body and connection cable.

Figure 9:
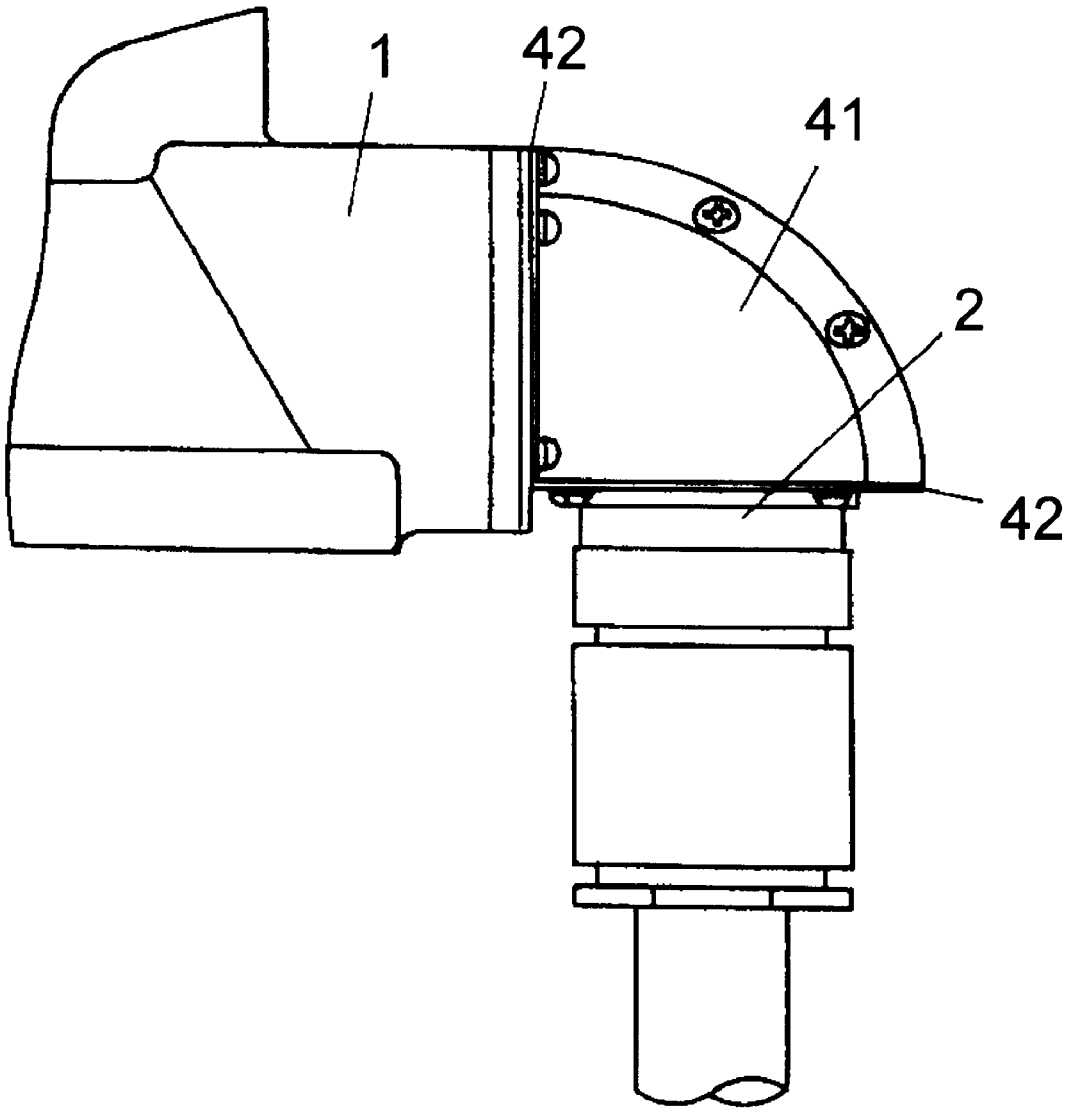
FIG. 9 is an explanatory diagram of mounting of an angle box of half-split structure on the robot lower connector section.

As shown in FIG. 9, when two angle boxes 41 stand between the robot main body 1 and connector section 2, the drawing direction of the connection cable can be changed from the horizontal direction to the vertical direction.

Therefore, by using the two divided angle boxes, the connection cable drawing direction can be changed easily at the site of the robot being operated by the user.

Figure 11:
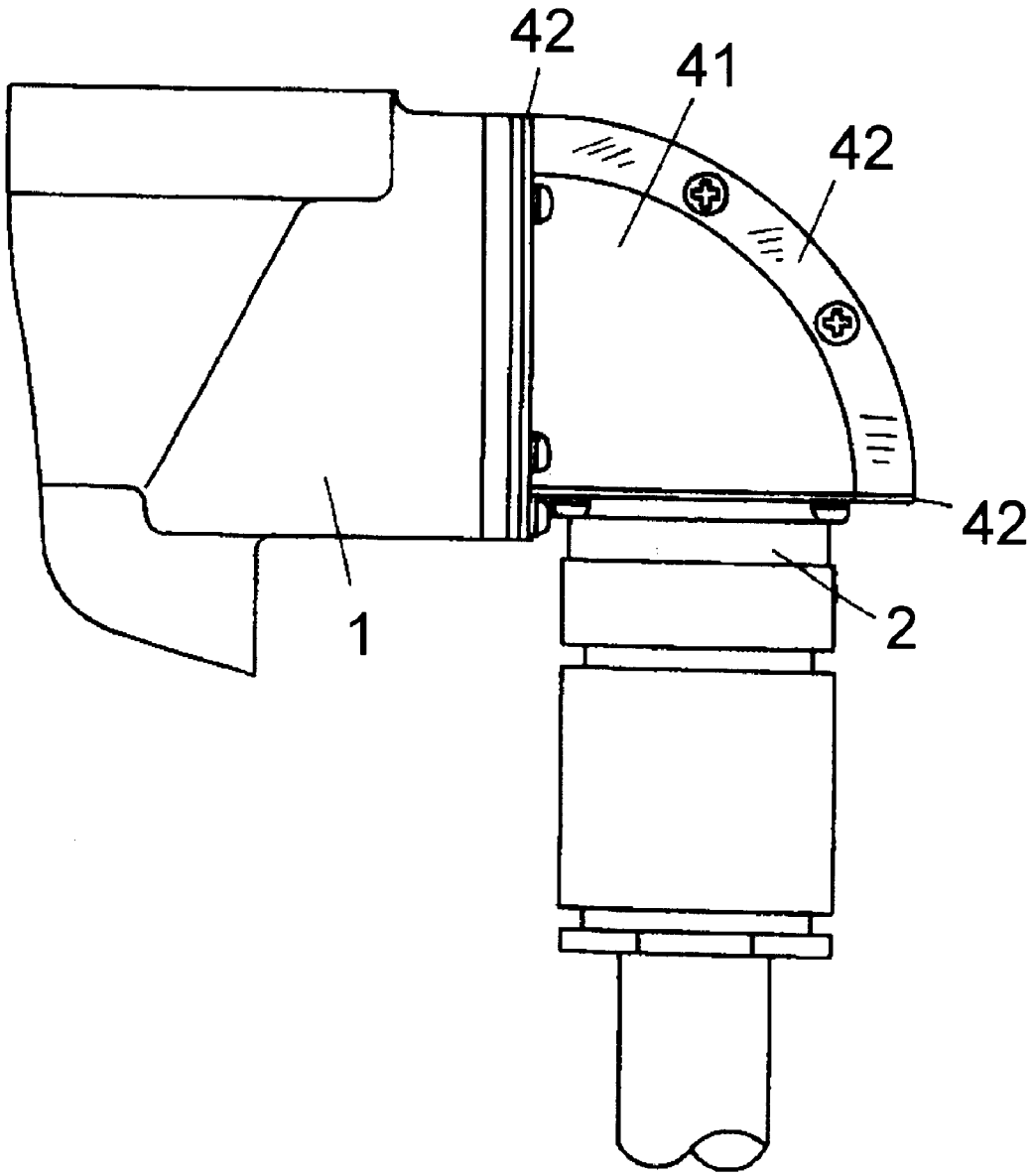
FIG. 11 is an explanatory diagram of mounting of an angle box of half-split structure on the lower part connector section of a downwardly depending type robot.

FIG. 11 shows that the same structure can be applied to the robot main body 1 of downwardly depending type.

Further, as shown in FIG. 6 and FIG. 7, the angle boxes 31, 41 may also contain an edge processing section 33 and an edge processing section 43, respectively. Each edge processing section is disposed in a guided part in contact with the cable, and is shaped in an arc. The edge processing section 33 and edge processing section 43 are polished. It hence prevents damage of cable due to friction when changing the cable drawing direction or operating the robot.

Moreover, as shown in FIG. 6 and FIG. 7, to protect from dust, a dust cover member 32 and a dust cover member 42 are provided on the entire surface of mounting surfaces 310, 410, respectively, of angle boxes in the lower part of the robot.

Therefore, the dust cover members are fixed between the robot connection cable wiring and angle box mounting part. Thus, the junction of connection cable is protected from dust.

As shown in FIG. 8, when the angle box 31 stands between the robot main body 1 and connector section 2, the dust cover member 32 is fixed to both mounting sides of the angle box. Thus, the junction of connection cable is protected from dust.

As shown in FIG. 9, when the angle box 41 stands between the robot main body 1 and connector section 2, the dust cover member 42 is fixed to both mounting sides of the angle box. Thus, the junction of connection cable is protected from dust.

In this way, the wires are protected from metal chips or welding spatters generated in the working environments of the robot.

FIG. 10 shows that the same structure can be applied to the robot main body 1 of downwardly depending type.

FIG. 11 shows that the same structure can be applied to the robot main body 1 of downwardly depending type.

Embodiment 3

Figure 12:
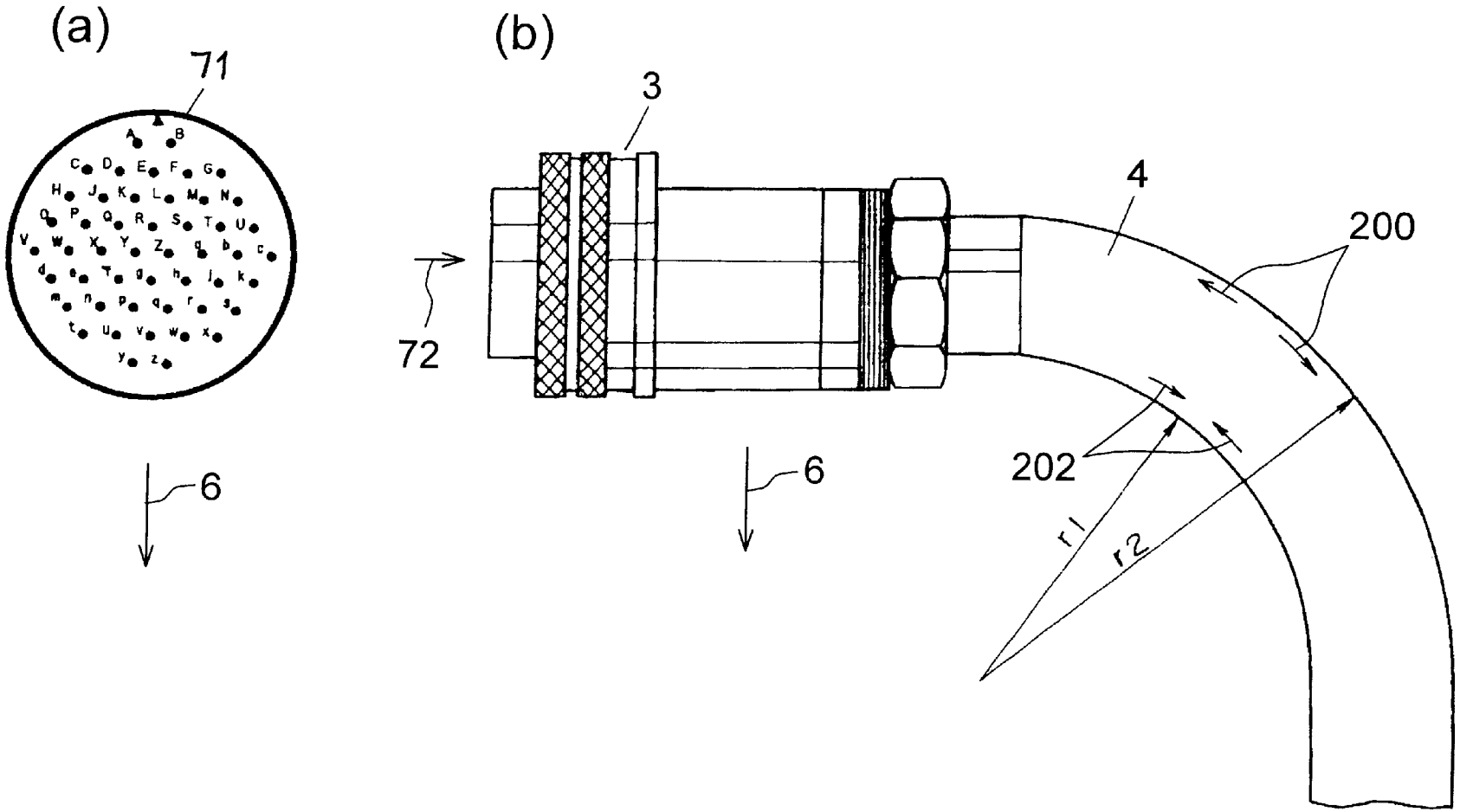
FIG. 12(*a*) is a pin configuration of a connection cable connector section.

For example, the connection cable connector 3 has a connector pin configuration 71 as shown in FIG. 12(*a*). In FIG. 12(*b*), end portions of wires contained in the connection cable 4 are processed and connected to the connector 3. FIG. 12(*a*) shows a pin configuration of the connector 3 as seen from the direction of arrow 72.

Figure 18:
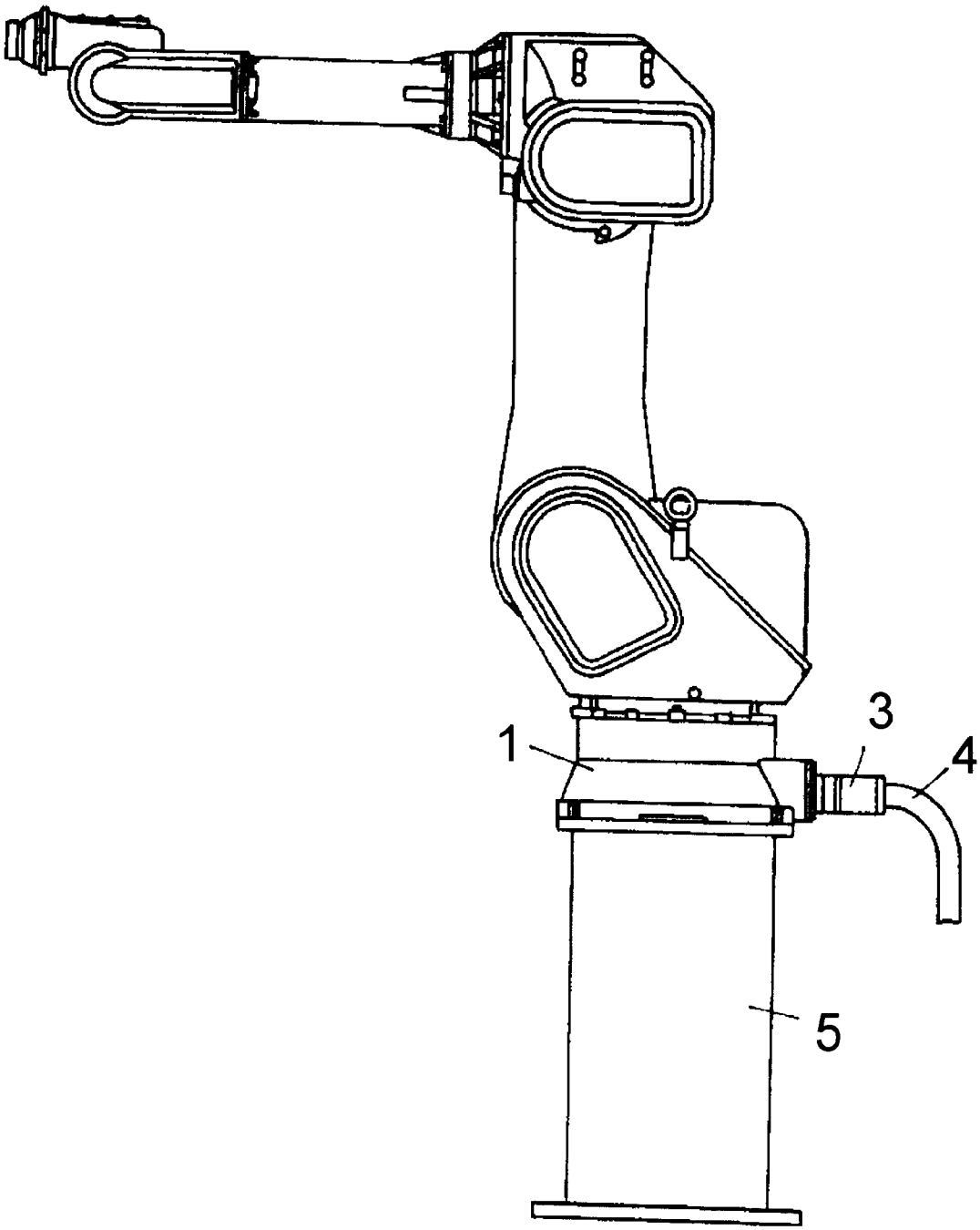
FIG.18 PRIOR ART
FIG. 18 is a diagram showing a state of mounting of a conventional robot on a platform.
Figure 19:
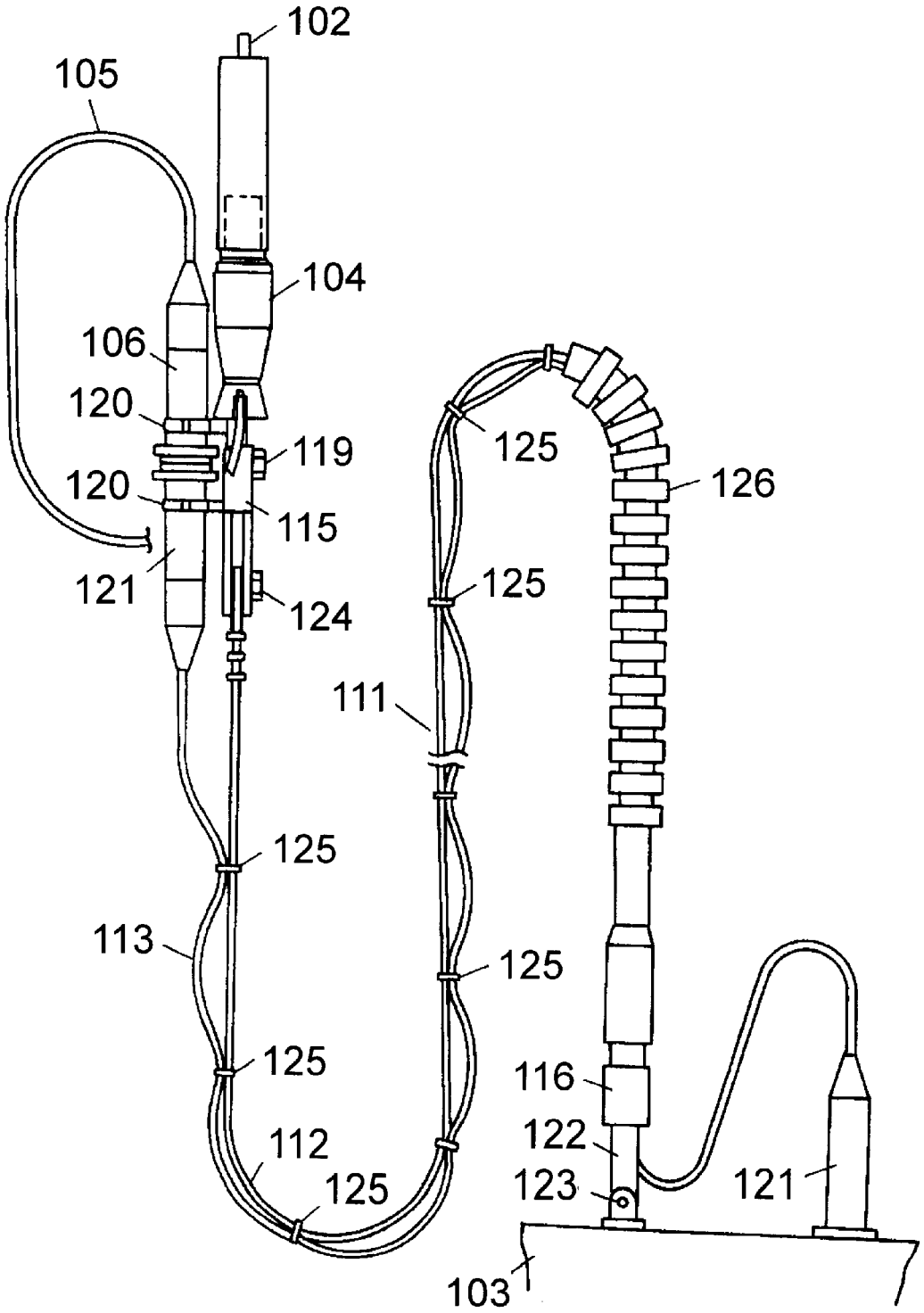
FIG.19 PRIOR ART
FIG. 19 is a specific structural diagram of conventional joint cable and a junction of a joint cable and a tether cable.

In the robot installation state as shown in FIG. 18, when such connection cable is connected to the robot main body, the connection cable 4 sags by its own weight.

At this time, as shown in FIG. 12(*b*), a contracting force in direction 202 along the circumference of the connection cable bending minor diameter r1 and a tensile force in direction 200 along the circumference of the connection cable bending major diameter r2 act at the same time. Arrow 6 shows the direction of gravity.

If a wire of fine sectional area is located at a position at which the tensile force of direction 200 is applied, it is not preferable considering from its strength.

As wires used in the robot, wires with sectional area of about AWG#15 are used in the motor armature system. In the control signal system, wires with sectional area of about AWG#28 are used.

The sectional area of AWG#15 is about 25 times as wide as that of AWG#28.

That is, concerning the wire tensile strength in the wire-end portion processing section of the connection cable connector 3, wires with sectional area of about AWG#15 are much stronger than wires with sectional area of about AWG#28.

Figure 13:
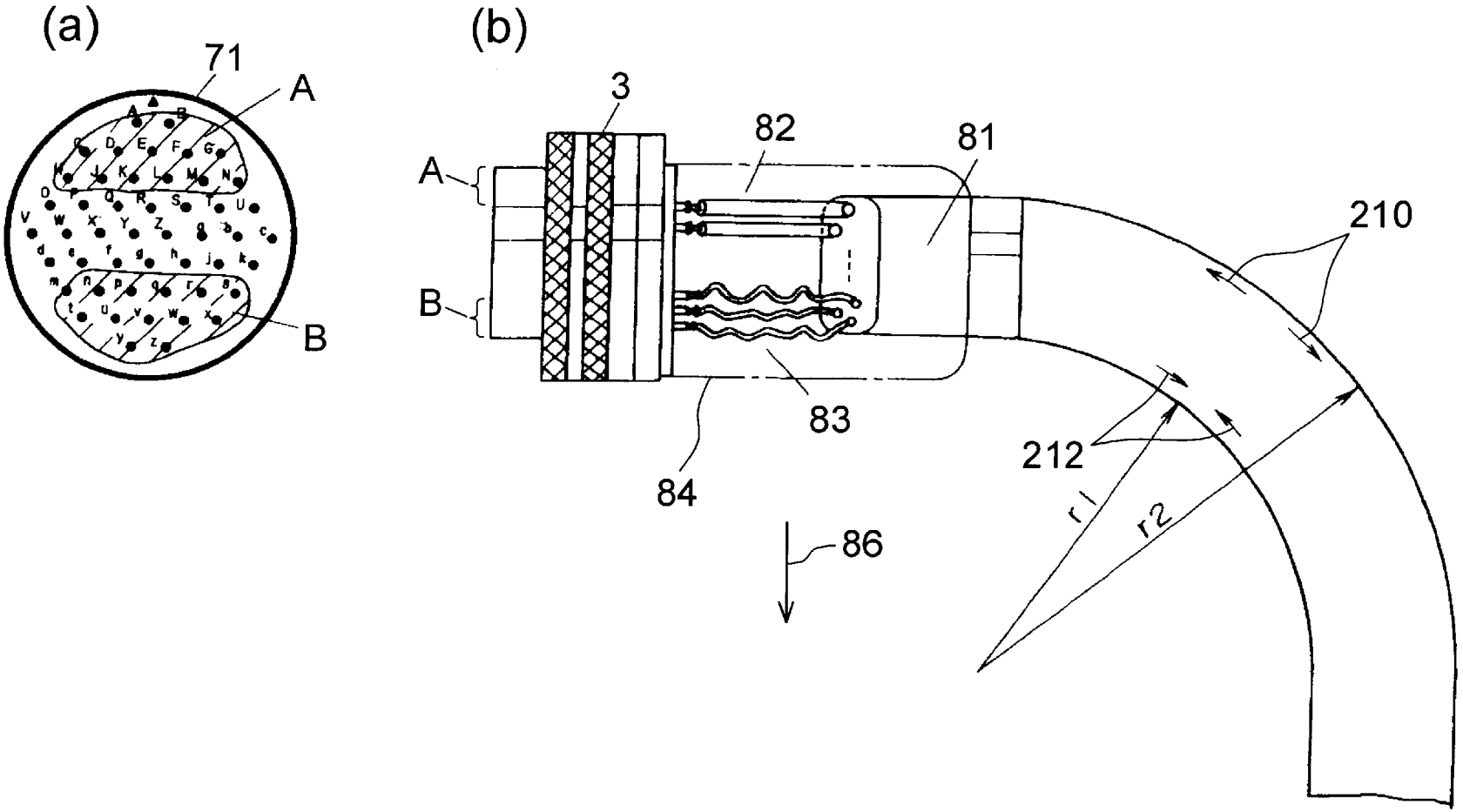
FIG. 13(*a*) is a wiring diagram of wires to the connection cable connector section pin of a composite cable type.

This embodiment is explained in FIG. 13(*a*), (*b*).

The connection cable connector 3 has a connector pin configuration 71, for example, as shown in FIG. 13(*a*). The connection cable is a composite cable 81. The connection cable includes a wire group 83 and a wire group 82. The sectional area of each wire of the wire group 82 is larger than the sectional area of each wire of the wire group 83. The end portions of connection cable are processed as follows: in the connection processing section 84.

The length after processing of the wires of the wire group 83 is longer than the length after processing of wires of the wire group 82 having a larger sectional area by about scores of millimeters. When the connection cable sags by its own weight, as shown in FIG. 13(*b*), a contracting force acts in direction 212 along the circumference of the connection cable bending minor diameter r1, and a tensile force acts in direction 210 along the circumference of the connection cable bending major diameter r2. These forces act only on the wire group 82 of wider sectional area of wire, and have no effect on the wire group 83 of smaller sectional area of wire.

Arrow 86 shows the direction of gravity.

Figure 15:
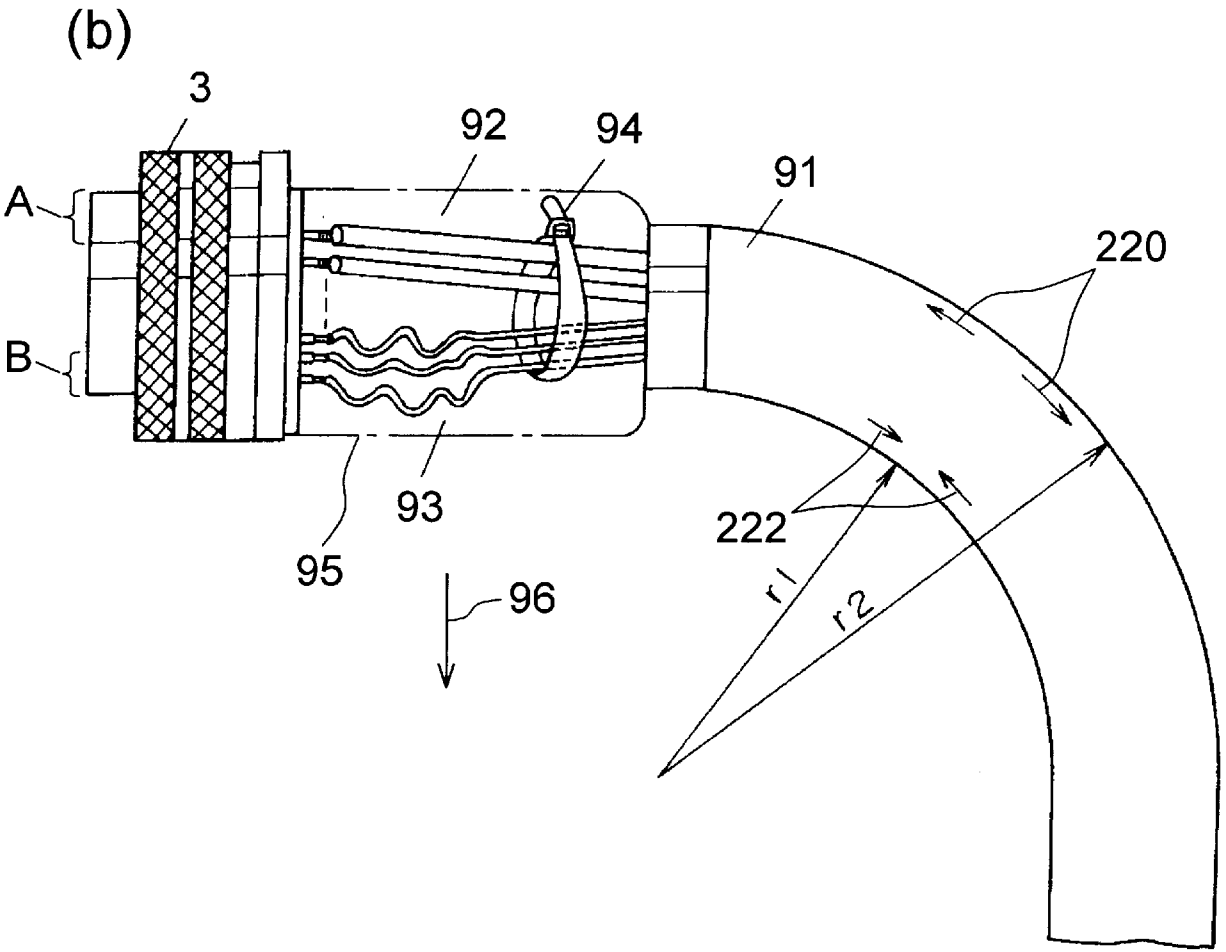
FIG. 15(*a*) is a wiring diagram of wires to the connector pin of a connection cable passing wires in a flexible tube.
Figure 15:
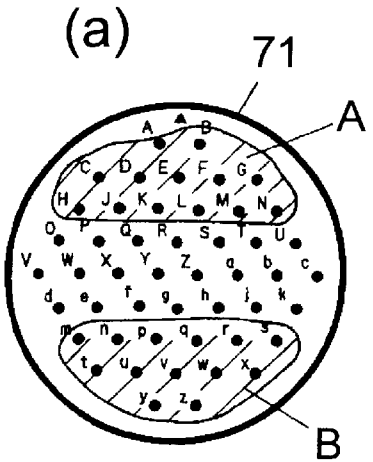

Other example is explained in FIG. 15(*a*), (*b*).

The connection cable connector 3 has a connection cable connector pin configuration 71 as shown in, for example, FIG. 15(*a*). The connection cable includes a wire group 93 and a wire group 92 in a tube. In a connection processing section 95, a binder 94 bundles the wire groups 92 and 93 near the end of the connection cable 91. Between the connector 3 and the binder 94, the length after processing of the wires of the wire group 93 is longer than the length after processing of wires of the wire group 92 having a larger sectional area by about scores of millimeters. Therefore, when the connection cable sags by its own weight, a contracting force in direction 222 and a tensile force in direction 220 shown in FIG. 15(*b*) act only on the wire group 92 of wider sectional area of wire, and have no effect on the wire group 93 of smaller sectional area of wire.

Arrow 96 shows the direction of gravity.

Other example is explained in FIG. 13(*a*), (*b*).

The connection cable connector 3 has a connector pin configuration 71, for example, as shown in FIG. 13(*a*). The connection cable is a composite cable 81. In the connection processing section 84, a wire group 83 is disposed in wiring region B of wire of connection cable connector pin configuration 71. Also a wire group 82 is disposed in wiring region A of wire of connection cable connector pin configuration 71. As mentioned above, the sectional area of each wire of the wire group 82 is larger than the sectional area of each wire of the wire group 83. When the cable sags by its own weight, a contracting force in direction 212 and a tensile force in direction 210 shown in FIG. 13(*b*) act only on the wire group 82 of wider sectional area of wire, and have no effect on the wire group 83 of smaller sectional area of wire. Arrow 86 shows the direction of gravity.

A different example is explained in FIG. 15(*a*), (*b*).

The connection cable connector 3 has a connection cable connector pin configuration 71, for example, as shown in FIG. 15(*a*). The connection cable includes a wire group 93 and a wire group 92 in a tube. As mentioned above, a binder 94 bundles the wire groups 92 and 93. In the connection processing section 95, the wire group 92 is disposed in wiring region A of wire of connection cable connector pin configuration 71. Also the wire group 93 is disposed in wiring region B of wire of connection cable connector pin configuration 71. As mentioned above, the sectional area of each wire of the wire group 92 is larger than the sectional area of each wire of the wire group 93. When the connection cable sags by its own weight, a contracting force in direction 222 and a tensile force in direction 220 shown in FIG. 15(*b*) act only on the wire group 92 of wider sectional area of wire, and have no effect on the wire group 93 of smaller sectional area of wire.

A further example is explained in FIG. 13(*a*), (*b*).

The connection cable connector 3 has a connector pin configuration 71, for example, as shown in FIG. 13(*a*). The connection cable is a composite cable 81. In the connection processing section 84, the length after processing of the wires of the wire group 83 is longer than the length after processing of wires of the wire group 82 by about scores of millimeters.

Further, the wire group 82 is disposed in wiring region A of wire of connection cable connector pin configuration 71. Also the wire group 83 is disposed in wiring region B of wire of connection cable connector pin configuration 71. Besides, the sectional area of each wire of the wire group 82 is larger than the sectional area of each wire of the wire group 83. Therefore, if the connection cable sags by its own weight, a contracting force in direction 212 and a tensile force in direction 2:10 shown in FIG. 13(*b*) act only on the wire group 82 of wider sectional area of wire, and have no effect on the wire group 83 of smaller sectional area of wire.

Another different example is explained in FIG. 15(*a*), (*b*).

The connection cable connector 3 has a connection cable connector pin configuration 71, for example, as shown in FIG. 15(*a*). The connection cable includes a wire group 93 and a wire group 92 in a tube. As mentioned above, a binder 94 bundles the wire groups 92 and 93. Between the connector 3 and the binder 94, the length after processing of the wires of the wire group 93 is longer than the length after processing of wires of the wire group 92 by about scores of millimeters.

Further, the wire group 92 is disposed in wiring region A of wire of connection cable connector pin configuration 71. Also the wire group 93 is disposed in wiring region B of wire of connection cable connector pin configuration 71. As mentioned above, the sectional area of each wire of the wire group 92 is larger than the sectional area, of each wire of the wire group 93. Therefore, if the connection cable sags by its own weight, a contracting force in direction 222 and a tensile force in direction 220 shown in FIG. 15(*b*) act only on the wire group 92 of wider sectional area of wire, and have no effect on the wire group 93 of smaller sectional area of wire.

In the embodiment, the wires of a larger sectional area are disposed in the position exposed to tensile force, and the wires of a smaller sectional area are disposed in the position exposed to contracting force. The length of wire of smaller sectional area is set longer than the length of wire of larger sectional area. Therefore, stress due to difference between the bending major diameter and bending minor diameter does not act. Further, in this embodiment, since angle connector is not necessary, the cost is not increased.

Embodiment 4

Figure 14:
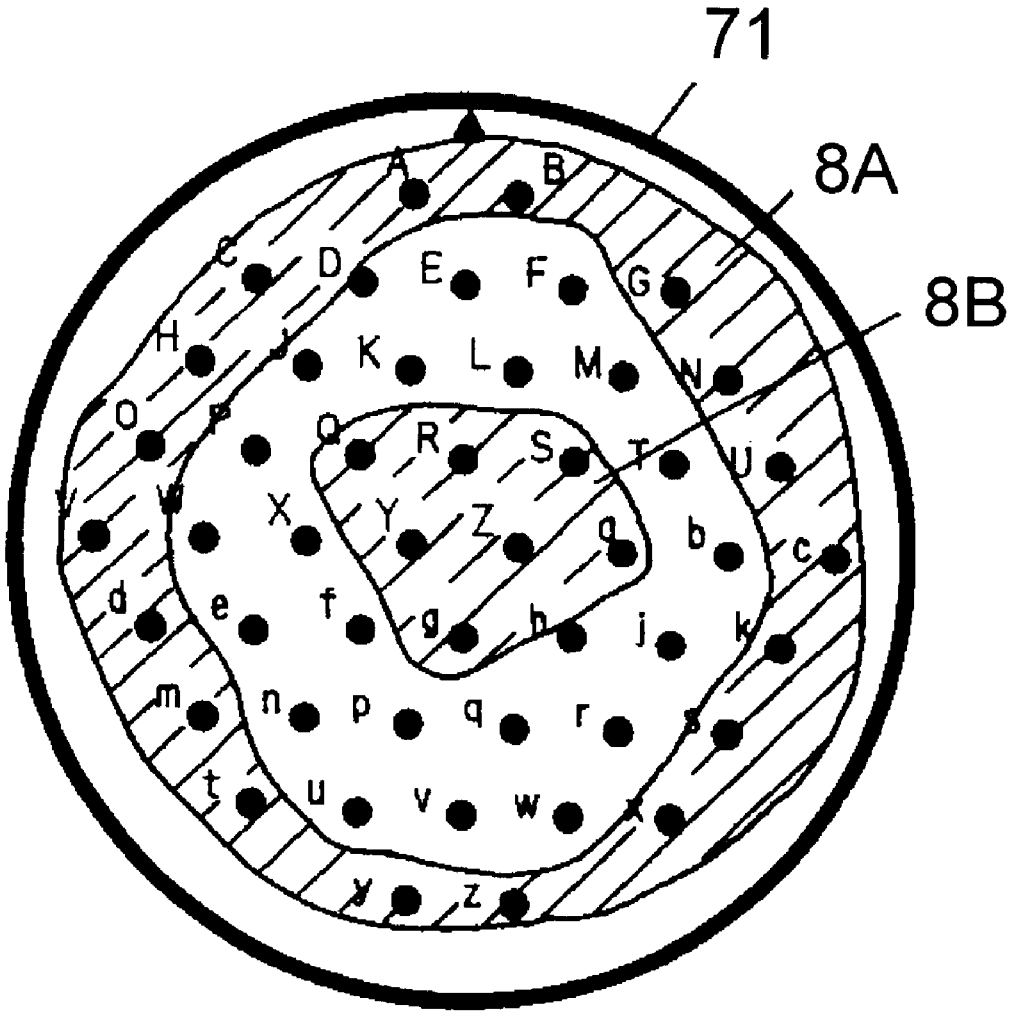
FIG. 14 is a pin configuration of a connection cable connector section.

This embodiment is explained by referring to FIG. 14.

The connection cable connector 3 has a connection cable connector pin configuration 71 as shown, for example, in FIG. 14. In a connection processing section, the connection cable includes a wire group with a smaller sectional area of each wire and a wire group of a larger sectional area of each wire. The wire group with larger sectional area is connected to wiring region 8A of wires on the outer circumference of the connection cable connector section. Also the wire group with smaller sectional area is connected to wiring region 8B of wires in the center of the connection cable connector section. As shown in FIG. 14, when the robot main body is installed on the floor 6, if the connection cable 4 is pulled, the wire group of larger sectional area of each wire supports and protects the wire group of smaller sectional area of each wire.

For example, when the robot is installed on the floor, the connection cable for linking between the robot and its control device is laid down horizontally on the floor.

In such a case, at the time of teaching or maintenance of the robot, the operator may drag and pull the connection cable by accident. In such an event, the connection cable apparatus of the invention withstands the impact applied to the connector section of the connection cable.

Figure 16:
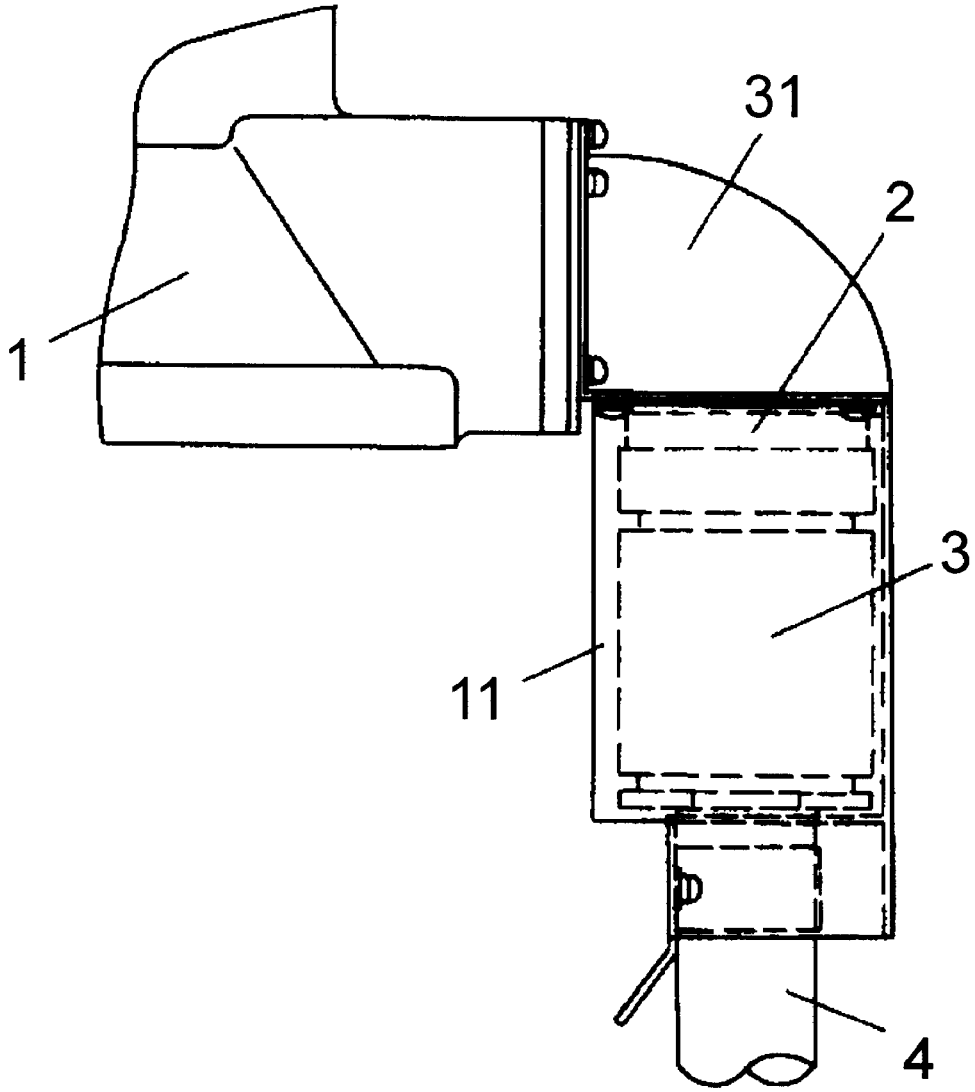
FIG. 16 is a diagram showing the state of an angle box and a reinforcement plate attached to the robot lower connector section.
Figure 17:
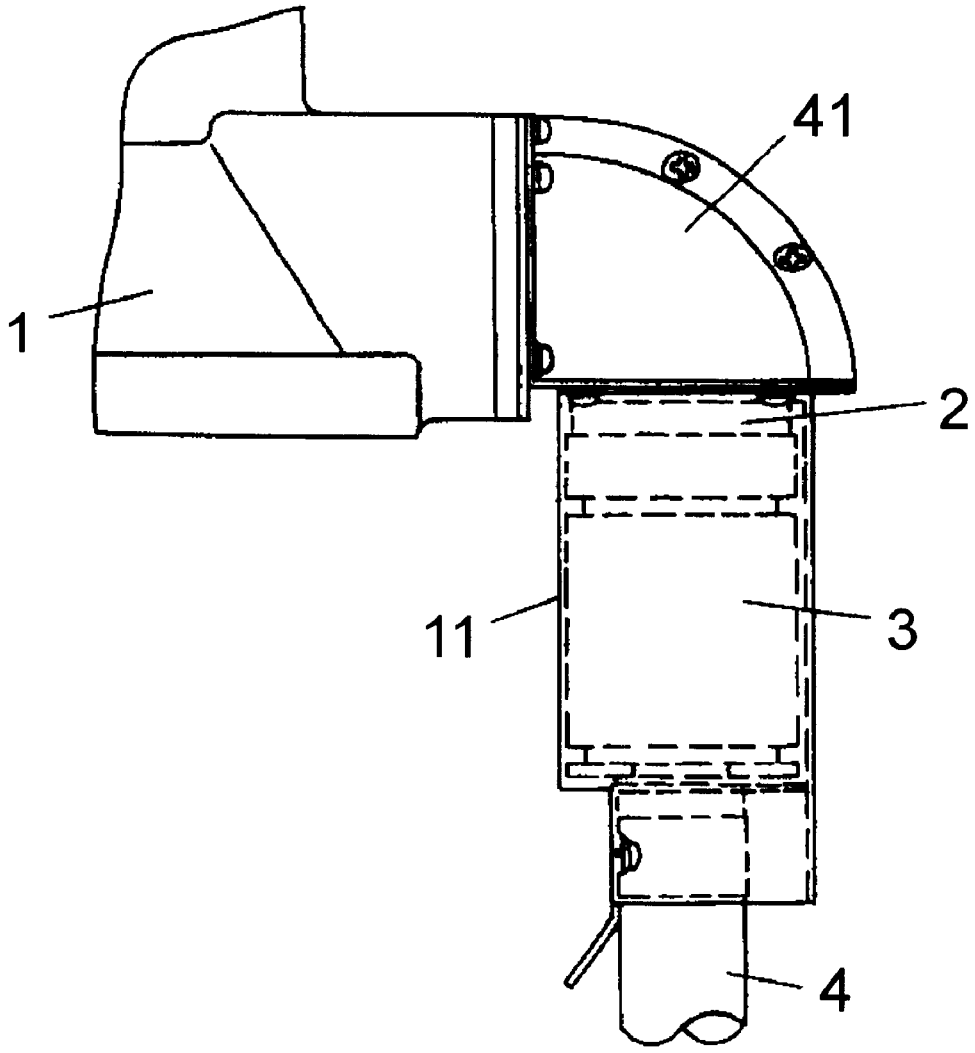
FIG. 17 is a diagram showing the state of an angle box of half-split structure and a reinforcement plate attached to the robot lower connector section.

FIG. 16 and FIG. 17 show combination of the first embodiment and second embodiment of the invention. If such examples are not presented, by properly combining the practical examples of the embodiments of the invention, a stronger and safer protective device of robot connection cables can be realized.

Thus, the invention brings about the following advantages.

1) In the case of a floor-mount robot, the connection cable for linking between the robot and its control device is laid down horizontally on the floor, and if the connection cable is dragged, it is possible to withstand the impact applied to the connector section at the junction of the robot main body lower part and the connection cable.

2) In the case of a robot mounted on a platform, if the connection cable sags due to its own weight in the gravity direction, any force larger than specified does not act directly on the strands of composite cable or connector pins at the tube terminating section. Therefore, the signal wires and power wires in the connection cable can be protected.

3) At the robot working site, the drawing direction of the connection cable can be changed easily. It is not necessary, therefore, to connect the connection connector section and connection cable main body straightly by using angle connectors. This is also a great merit from the viewpoint of cost.

Moreover, if the connection cable is pulled out in the vertical direction from the robot, eccentric load is not applied to the connection cable connector section.

Further, by properly combining the means of the invention depending on the robot installation situation, a stronger and safer protective device of robot connection cables can be realized.

What is claimed is:

1. A connection cable apparatus between a robot manipulator and a control device thereof, said connection cable apparatus comprising:

a connection cable including plural wires comprising at least one signal wire and at least one power wire, each of said plural wires having an end portion, and a connection processing section for processing said end portions of said plural wires, wherein a first wire of the plural wires has a first sectional area and is longer than a second wire of the plural wires, wherein said second wire has a second sectional area that is larger than said first sectional area, and wherein said first wire is longer than said second wire in said connection processing section.

2. The connection cable apparatus of claim 1, wherein said connection cable includes a flexible tube, wherein said plural wires pass through said tube, and wherein said plural wires are bundled into a plurality of groups in said connection processing section.

3. A connection cable apparatus between a robot manipulator and a control device thereof, said connection cable apparatus comprising:

a connection cable including plural wires comprising at least one signal wire and at least one power wire, and a connection processing section for processing an end portion of said cable, wherein said plural wires are divided into a first group including a first plurality of wires having a first sectional area and a second group including a second plurality of wires having a second sectional area in said connection processing section, wherein said first sectional area is smaller than said second sectional area, wherein said second group is disposed in a position exposed to a tensile force when the connection cable sags in a direction of gravity, and wherein said first group is disposed in a position exposed to a contracting force when the connection cable sags in a direction of gravity.

4. The connection cable apparatus of claim 3, wherein the length of said first plurality of wires is longer than the length of said second plurality of wires.

5. The connection cable apparatus of claim 3, wherein said connection cable includes a flexible tube, wherein said plural wires pass through said tube, and wherein said plural wires are bundled into a plurality of groups by said connection processing section.

6. The connection cable apparatus of claim 5, wherein the length of said first plurality of wires is longer than the length of said second plurality of wires.

7. A connection cable apparatus between a robot manipulator and a control device thereof, said connection cable apparatus comprising:

a connection cable having an end portion and a connector section having an outer circumference and a center, said connection cable including plural wires comprising at least one signal wire and at least one power wire, and a connection processing section for processing said end portion, wherein said plural wires are divided into a first group including a first plurality of wires having a first sectional area and a second group including a second plurality of wires having a second sectional area in said connection processing section, wherein said first sectional area is smaller than said second sectional area, wherein said second group is disposed on said outer circumference of said connector section, and wherein said first group is disposed in said center of said connector section.

8. A connection cable apparatus between a robot manipulator and a control device thereof, said connection cable apparatus comprising:

a connection cable including plural wires comprising at least one of a signal wire and a power wire, each of said plural wires having an end portion, and a connection processing section for processing said end portions of said plural wires, wherein a first wire of the plural wires has a first sectional area and is longer than a second wire of the plural wires, wherein said second wire has a second sectional area that is larger than said first sectional area, and wherein said first wire is longer than said second wire in said connection processing section.

9. The connection cable apparatus of claim 8, wherein said connection cable includes a flexible tube, wherein said plural wires pass through said tube, and wherein said plural wires are bundled into a plurality of groups in said connection processing section.

10. A connection cable apparatus between a robot manipulator and a control device thereof, said connection cable apparatus comprising:

a connection cable including plural wires comprising at least one of a signal wire and a power wire, and a connection processing section for processing an end portion of said cable, wherein said plural wires are divided into a first group including a first plurality of wires having a first sectional area and a second group including a second plurality of wires having a second sectional area in said connection processing section, wherein said first sectional area is smaller than said second sectional area, wherein said second group is disposed in a position exposed to a tensile force when the connection cable sags in a direction of gravity, and wherein said first group is disposed in a position exposed to a contracting force when the connection cable sags in a direction of gravity.

11. The connection cable apparatus of claim 10, wherein the length of said first plurality of wires is longer than the length of said second plurality of wires.

12. The connection cable apparatus of claim 10, wherein said connection cable includes a flexible tube, wherein said plural wires pass through said tube, and wherein said plural wires are bundled into a plurality of groups by said connection processing section.

13. The connection cable apparatus of claim 12, wherein the length of said first plurality of wires is longer than the length of said second plurality of wires.

14. A connection cable apparatus between a robot manipulator and control device thereof, said connection cable apparatus comprising:

a connection cable having an end portion and a connector section having an outer circumference and a center, said connection cable including plural wires comprising at least one of a signal wire and a power wire, and a connection processing section for processing said end portion, wherein said plural wires are divided into a first group including a first plurality of wires having a first sectional area and a second group including a second plurality of wires having a second section area in said connection processing section, wherein said first sectional area is smaller than said second sectional area, wherein said second group is disposed on said outer circumference of said connector section, and wherein said first group is disposed in said center of said connector section.

* * * * *